US005292218A

United States Patent [19]

Ikenouchi et al.

[11] Patent Number: 5,292,218

[45] Date of Patent: Mar. 8, 1994

[54] APPARATUS FOR TRANSFERRING A MOTOR VEHICLE AND MULTISTORY PARKING LOT

[75] Inventors: Terumasa Ikenouchi; Niro Okabe; Hirofumi Ishikawa; Haruki Takeuchi; Osamu Nagata, all of Kawasaki, Japan

[73] Assignee: NKK Corporation, Tokyo, Japan

[21] Appl. No.: 913,585

[22] Filed: Jul. 14, 1992

[30] Foreign Application Priority Data

| | | | |
|---|---|---|---|
| Jul. 19, 1991 | [JP] | Japan | 3-179270 |
| May 22, 1992 | [JP] | Japan | 4-154110 |
| May 22, 1992 | [JP] | Japan | 4-154111 |

[51] Int. Cl.[5] ..... E04H 6/18

[52] U.S. Cl. ..... 414/256; 414/231

[58] Field of Search ..... 414/231, 232, 253-256, 414/259, 264, 273, 277, 281, 282, 667, 671

[56] References Cited

U.S. PATENT DOCUMENTS

| | | | |
|---|---|---|---|
| 2,985,328 | 5/1961 | Fitch | 414/667 |
| 2,995,263 | 8/1961 | Fitch | 414/254 X |
| 3,561,620 | 2/1971 | Willis | 414/282 |
| 3,984,012 | 10/1976 | Ennis et al. | 414/231 |
| 4,595,332 | 6/1986 | Loomer | 414/282 X |
| 4,936,730 | 6/1990 | Morioka | 414/282 X |
| 4,968,208 | 11/1990 | Friberg | 414/256 |
| 4,971,505 | 11/1990 | Sawyer | 414/232 |
| 4,971,506 | 11/1990 | Givati | 414/255 X |
| 5,096,363 | 3/1992 | Weinert et al. | 414/671 |

FOREIGN PATENT DOCUMENTS

| | | | |
|---|---|---|---|
| 3301595 | 7/1984 | Fed. Rep. of Germany | 414/671 |
| 51-141181 | 4/1976 | Japan . | |
| 284678 | 11/1989 | Japan | 414/232 |
| 115475 | 4/1990 | Japan | 414/231 |
| 574387 | 9/1977 | U.S.S.R. | 414/277 |
| 951958 | 3/1964 | United Kingdom | 414/256 |
| WO88/04350 | 6/1988 | World Int. Prop. O. . | |
| WO97/123-96A1 | 8/1991 | World Int. Prop. O. . | |

*Primary Examiner*—David A. Bucci

*Attorney, Agent, or Firm*—Frishauf, Holtz, Goodman & Woodward

[57] ABSTRACT

Apparatus for transferring a motor vehicle comprises a frame body, two pairs of slide forks, each holding front and rear wheels of a motor vehicle respectively and moving the motor vehicle, the two pairs of slide forks moving in a direction perpendicular to a longitudinal direction of the frame body, the two pairs of slide forks having a first pair of slide forks positioned on the side of front wheels and a second pair of slide forks on the side of rear wheels in the frame body, a first adjusting device for adjusting a distance between the first pair of slide forks and the second pair of slide forks to be equal to a distance between a shaft of front wheels and a shaft of rear wheels, the first adjusting device being positioned on at least one side out of the side of front wheels and the side of rear wheels and moving at least one pair of slide forks in a longitudinal direction of the frame body, and a second adjusting device for adjusting a hold distance between slide forks forming each of the first pair of slide forks and the second pair of slide forks, the hold distance being adjusted to a diameter of each of tires. A multistory parking lot comprises an entrance and an exit, a rack for containing a motor vehicle, and an apparatus for transferring a motor vehicle to the rack for containing a motor vehicle.

16 Claims, 13 Drawing Sheets

APPARATUS FOR TRANSFERRING A MOTOR VEHICLE AND MULTISTORY PARKING LOT

BACKGROUND OF THE INVENTION

The present invention relates to an apparatus for transferring a motor vehicle without using any pallet and a multistory parking lot using the apparatus for transferring a motor vehicle.

DESCRIPTION OF THE RELATED ARTS

In a multistory parking lot having multistage containment racks, an apparatus for transferring a motor vehicle from an entrance of the multistory parking lot to its containment rack and for transferring a motor vehicle from its containment rack to its exit is used. In the prior art multistory parking lot, a motor vehicle is carried on a pallet sent to an entrance of the multistory parking lot, the pallet is moved by an ordinary slide fork mounted on a transfer apparatus, and the motor vehicle is placed on the transfer apparatus. This transfer apparatus is sent to an empty containment rack, and the pallet with the motor vehicle on the transfer apparatus is placed in the containment rack. When the motor vehicle is sent off from the containment rack, the pallet with the motor vehicle on the transfer apparatus is moved by the slide fork, and sent to the exit.

Moreover, Japanese Patent Application Laid Open No. 141181/76 discloses, for example, a transfer apparatus which transfers a motor vehicle by putting the motor vehicle on a conveyer capable of freely moving without using any pallet and holding the outsides of front and rear wheels of the motor vehicle with slide forks. In this apparatus, a position of the motor vehicle is determined relative to the slide forks by moving the motor vehicle forward and backward by means of a free conveyer, and the motor vehicle is transferred by holding the outsides of the front and rear wheels of the motor vehicle with the slide forks.

However, when the motor vehicle placed on the pallet is transferred as described above, the pallet needs to be returned to the entrance after the motor vehicle is sent off at the exit. Therefore, a transfer means for returning the pallet is necessary. In preparation for an unbalance of the number of motor vehicles coming in and going out, a pallet stock room for containing empty pallets is necessary. Further, in the case where the unbalance of the number of motor vehicles coming in and going out is great, there occurs the necessity of containing empty pallets in empty containment racks. In consequence, an additional space is required, and wasteful labor is spent for moving only the empty pallets, which gives rise to a very low effectiveness of equipment as a whole. Moreover, pallets corresponding to the number of containment racks are needed, which leads to an increase of equipment cost and management cost.

When front and rear wheels of a motor vehicle are held by slide forks, a pallet is not required. As a result, the above-described disadvantage is removed. However, since the motor vehicle is transferred, the outsides of the front and rear wheels being put between the slide forks, the motor vehicle can be in an unstable state during running of a stacker crane. Particularly, when the hand brakes remain not applied to the motor vehicle, it is difficult to hold the motor vehicle by surely holding the outsides of front and rear wheels of the motor vehicle. When the hand brakes remain not applied to the motor vehicle as mentioned above, the motor vehicle is moved by pressing the inside of the front wheels, to which the brakes are not applied, by use of slide forks after having held the outsides of front and rear wheels by means of the slide forks. It is difficult, however, to detect whether the hand brakes are applied to the motor vehicle or not.

Further, since there is no conveyor capable of freely moving in a containment rack when a motor vehicle contained in the containment rack is sent off from the containment rack, wheels of the motor vehicle are forced to move on a floor of the containment rack when the position of the motor vehicle is determined relative to slide forks. In this case, there is a possibility that tires around the wheels can be damaged.

SUMMARY OF THE INVENTION

A first object of the present invention is to solve the above-described problems and to provide an apparatus for transferring a motor vehicle without using any pellet. A second object of the present invention is to provide a multistory parking lot wherein an apparatus for transferring a motor vehicle which has no pallet is used. The other objects of the present invention are to provide a multistory parking lot, in which a position of a motor vehicle to be placed into an apparatus for transferring a motor vehicle is exactly determined and which has a safety device at the entrance of the multistory parking lot, by use of which the motor vehicle can be surely transferred in safety.

An apparatus for transferring a motor vehicle which attains the objects of the present invention comprises:

a frame body;

two pairs of slide forks, each of which holds front wheels and rear wheels of a motor vehicle respectively and moves the motor vehicle, said two pairs of slide forks moving in a direction perpendicular to a longitudinal direction of the frame body;

said two pairs of slide forks having a first pair of slide forks positioned on the side of front wheels and a second pair of slide forks on the side of rear wheels in said frame body;

a first adjusting means for adjusting a distance between said first pair of slide forks and said second pair of slide forks to be equal to a distance between a shaft of front wheels and a shaft of rear wheels, said first adjusting means being positioned on at least one side out of the side of front wheels and the side of rear wheels and said first adjusting means moving at least one pair of slide forks in a longitudinal direction of the frame body; and a second adjusting means for adjusting a hold distance between slide forks forming each of said first pair of slide forks and said second pair of slide forks, said hold distance being adjusted to a diameterof each of the tires.

A multistory parking lot comprises:

an entrance and an exit of the multistory parking lot;

a rack for containing a motor vehicle; and an apparatus for transferring a motor vehicle to the rack for containing a motor vehicle.

The above objects and other objects and advantages of the present invention will become apparent from the detailed description to follow, taken in conjunction with the appended drawings.

DETAILED DESCRIPTION OF THE PREFERRED EMBODIMENTS

Figure 1:
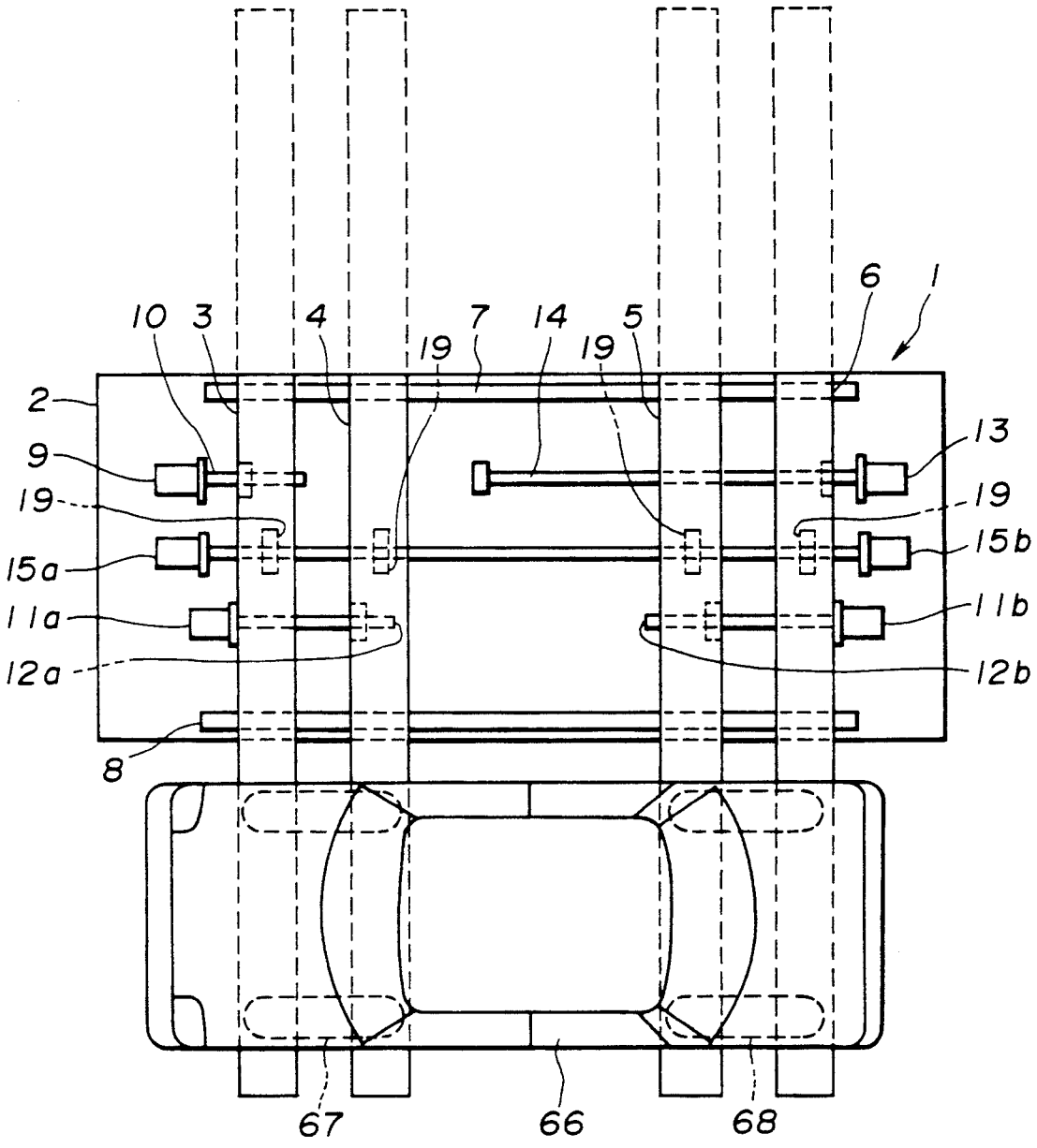
FIG. 1 is a schematic illustration showing an outlook of an apparatus for transferring a motor vehicle of an example of the present invention.

As shown in the schematic illustration showing an outlook of an apparatus for transferring a motor vehicle in FIG. 1, the apparatus 1 for transferring a motor vehicle has a frame 2 as a main body, a pair of slide forks 3, 4 positioned on the side of front wheels in the frame 2 and a pair of slide forks 5, 6 on the side of rear wheels in the frame 2. Each of the slide forks 3 to 6 are positioned so that a sliding direction of each of the slide forks can be perpendicular to a longitudinal direction of the frame 2. Each of the slide forks is movably mounted on two rails 7, 8 arranged along the longitudinal direction of the frame 2.

The slide fork 3 on the side of front wheels can be moved by a feed screw 10 connected to a position control motor 9 on the rails 7, 8. A distance between the slide fork 3 and slide fork 4 can be varied by the feed screw 12*a* connected to a distance changing motor 11*a*. The slide fork 5 on the side of rear wheels can be moved by a feed screw 14 connected to a distance changing motor 13 on the rails 7,8. A distance between the slide fork 5 and slide fork 6 can also be varied by a feed screw 12*b* connected to a distance changing motor 11*b*. Fork expansion motors 15*a*, 15*b* are positioned at the center of the slide fork 3 on the side of front wheels and at the center of the slide fork 6 on the side of rear wheels.

Figure 2:
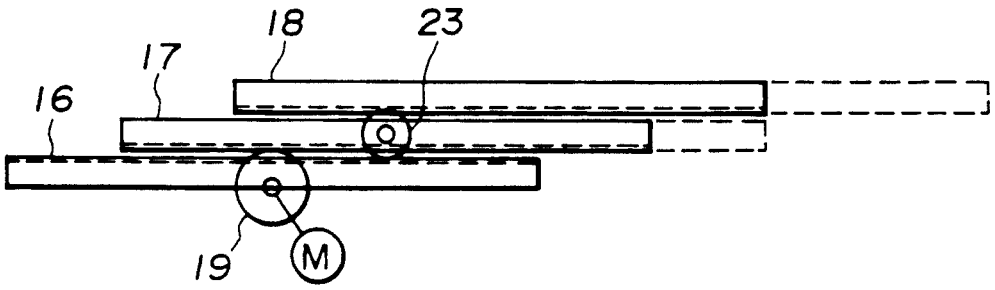
FIG. 2 is an explanatory view showing a structure of a slide fork of the present invention.
Figure 3:
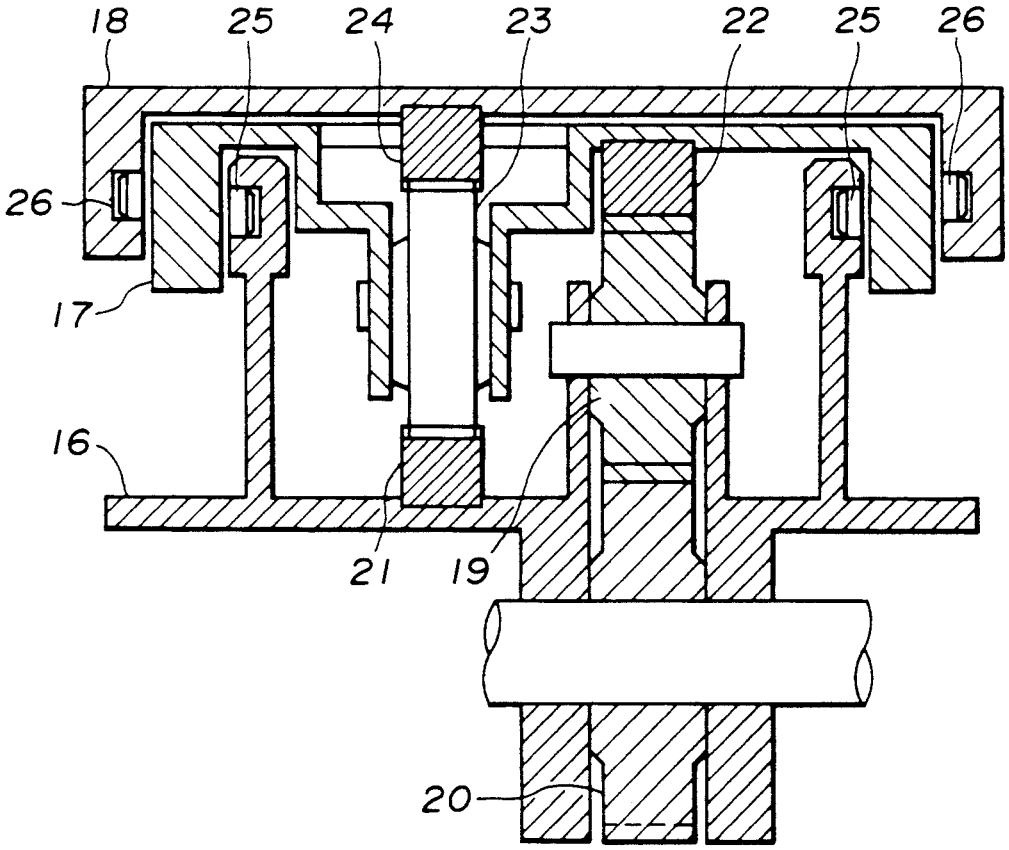
FIG. 3 is a sectional view showing a center portion of the slide fork of the present invention.

As shown in an explanatory view of FIG. 2 and in a sectional view showing the center portion of FIG. 3, each of the slide forks 3 to 6 has a base plate 16, a center beam 17 and a top beam 18. A gear 19 is rotatably mounted on the center portion of the base plate 16 and connected to fork expansion motors 15*a*, 15*b* via gear assembly 20. A rack 21 is positioned on the upper surface of the base plate 16 over the entire length of the base plate 16 in the longitudinal direction thereof. A rack 22 engaging with the gear 19 is positioned on the lower surface of the center beam 17 over the entire length of the center beam 17 in the longitudinal length thereof. A pinion 23 engaging with the rack 21 of the base plate 16 is rotatably mounted on the center portion of the center beam 17. A rack 24 engaging with the pinion 23 is positioned on the lower surface of the top beam 18 over the entire length of the top beam 18 in the longitudinal direction thereof.

The center beam 17 is guided by a linear rolling guide section 25 along the side of the base plate 16 and moved right and left by substantially half an entire length of the base plate 16. The top beam 18 is guided by a linear rolling guide section 26 along the side of the center beam 17. In this way, the thickness of each of the slide forks 3 to 6 can be decreased by guiding the center beam 17 and the top beam 18 by use of the linear rolling guide sections 25 and 26. Accordingly, when the slide forks 3 to 6 are moved forward, the center beam 17 and the top beam 18 are prevented from striking against a motor vehicle body and mudguards.

Figure 4:
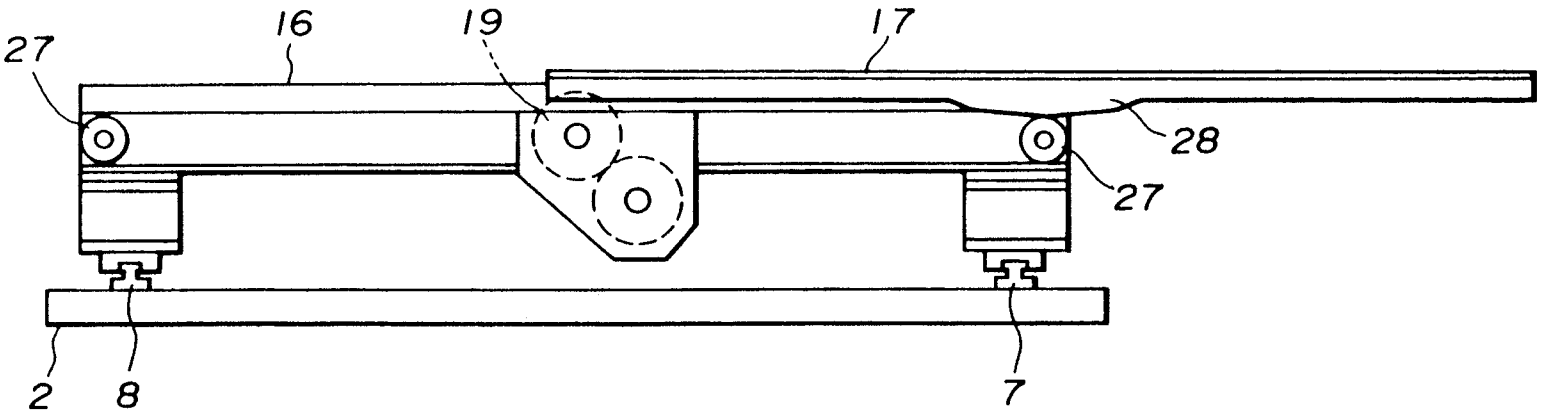
FIG. 4 is a side elevation showing a base plate and a center beam of the present invention.

As shown in the side elevation of FIG. 4, a roller 27 is positioned on both sides of the end of the base plate 16, and a cam 28 engaging with the roller 27 is positioned on both sides of the center portion of the center beam 17.

Figure 5:
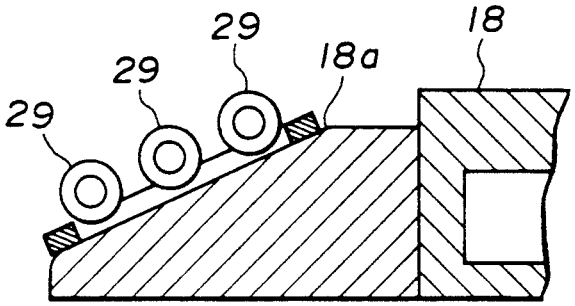
FIG. 5 is a sectional view showing a tire support face of a top beam of the present invention.
Figure 6:
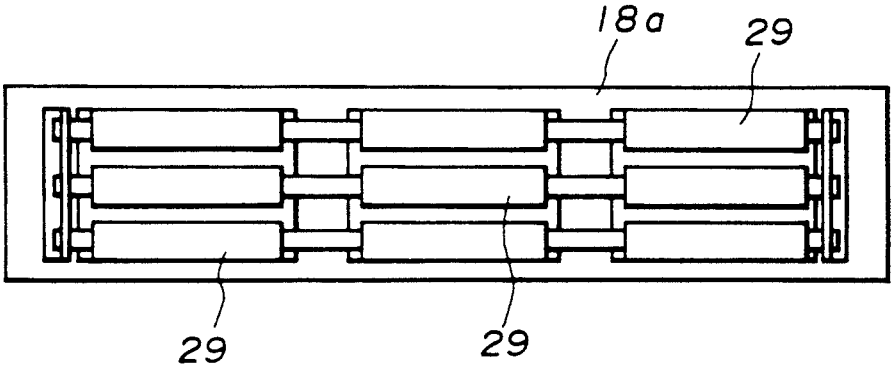
FIG. 6 is a top view showing the tire support face of the present invention.
Figure 7:
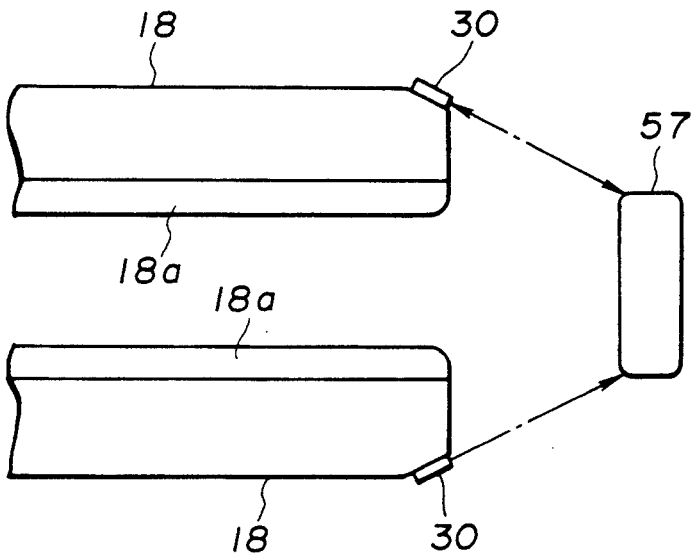
FIG. 7 is an explanatory view showing a state of a mounted optical sensor of the present invention.

As shown in the sectional view of FIG. 5 and in the top view of FIG. 6, rollers 29 for holding tires in a plurality of stages, for example, in three stages are positioned on a hold face 18*a* for holding tire on the top beam 18 in the longitudinal direction thereof. A positive type optical sensor 30 is mounted at the end of the top beam 18 on the side opposite to the hold face 18*a* for holding tires of the top beam 18, an optical axis of the optical sensor 30 being inclined at a predetermined angle toward the hold face 18*a* for holding tires as shown in FIG. 7.

Figure 8:
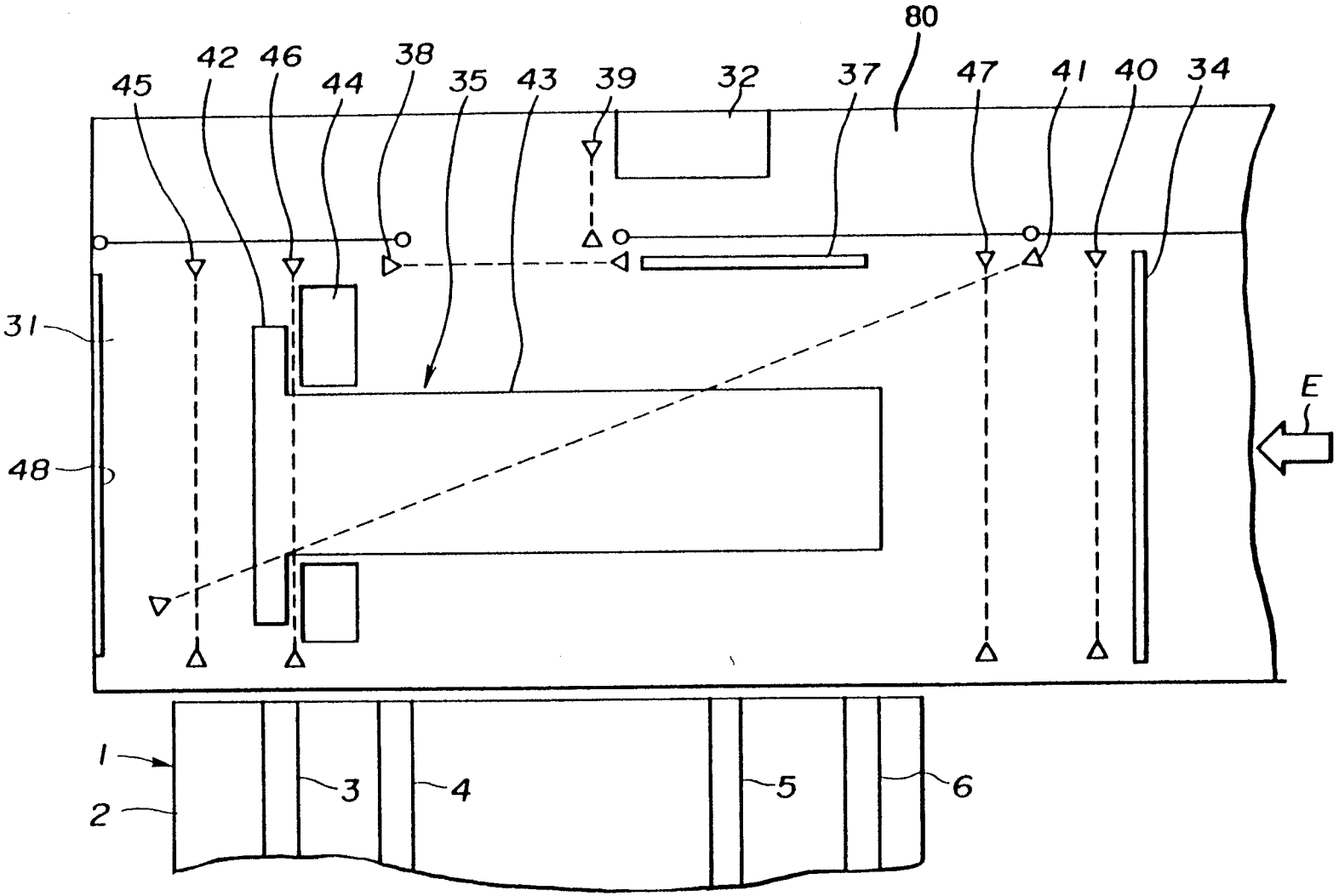
FIG. 8 is a schematic illustration showing an entrance of a multistory parking lot of the present invention.
Figure 11:
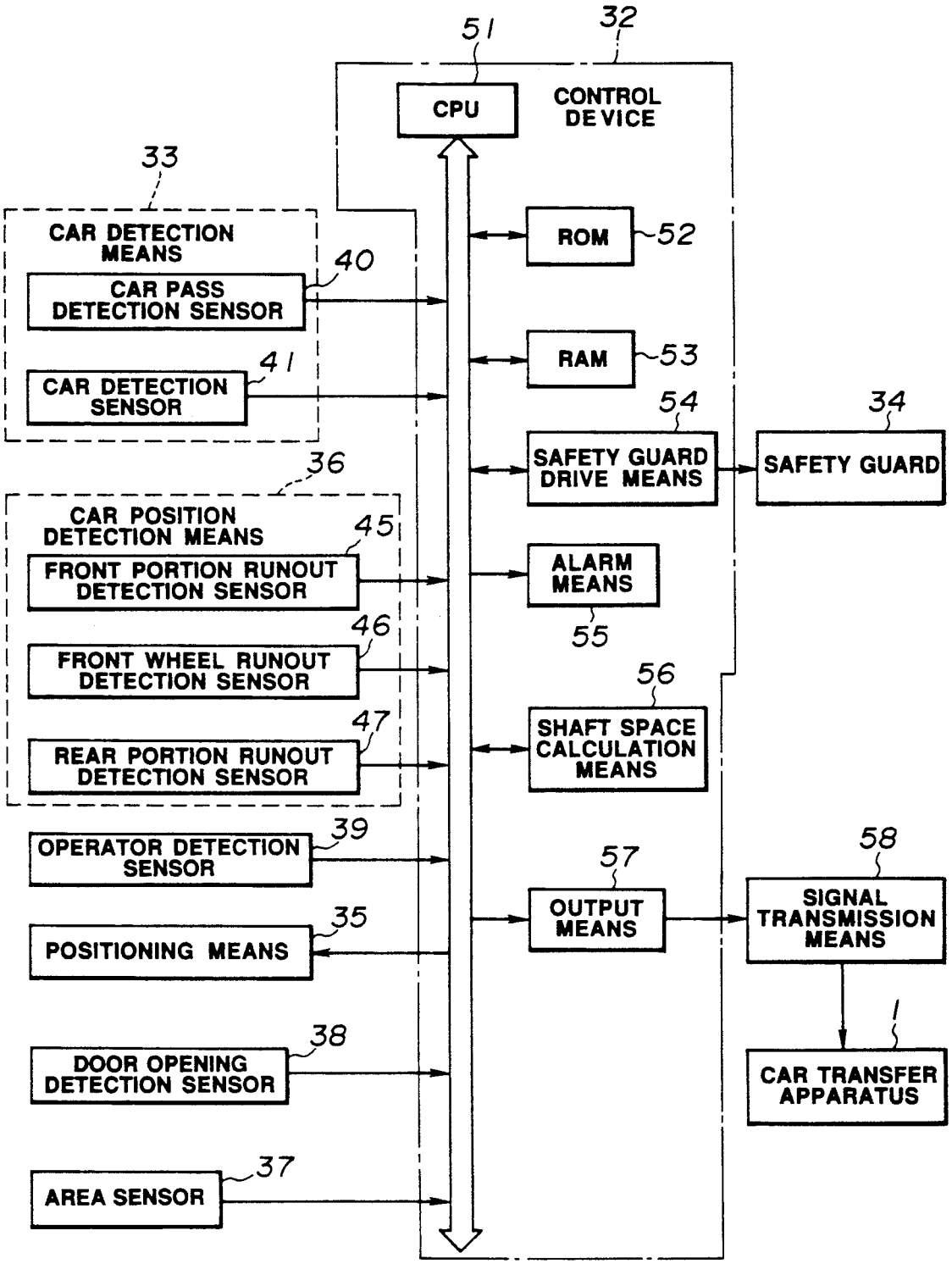
FIG. 11 is a block diagram showing a control section of a safety device at the entrance of the multistory parking lot of the present invention.

As shown in the schematic illustration of FIG. 8 and in the block diagram of FIG. 11, a control device 32 for controlling the entire entrance 31 of the multistory parking lot, a motor vehicle position detection means 36, an area sensor 37, a door opening detection sensor 38 and an operator detection sensor 39 are arranged at the entrance 31 of the multistory parking lot using the above-described apparatus 1 for transferring a motor vehicle.

Figure 9:
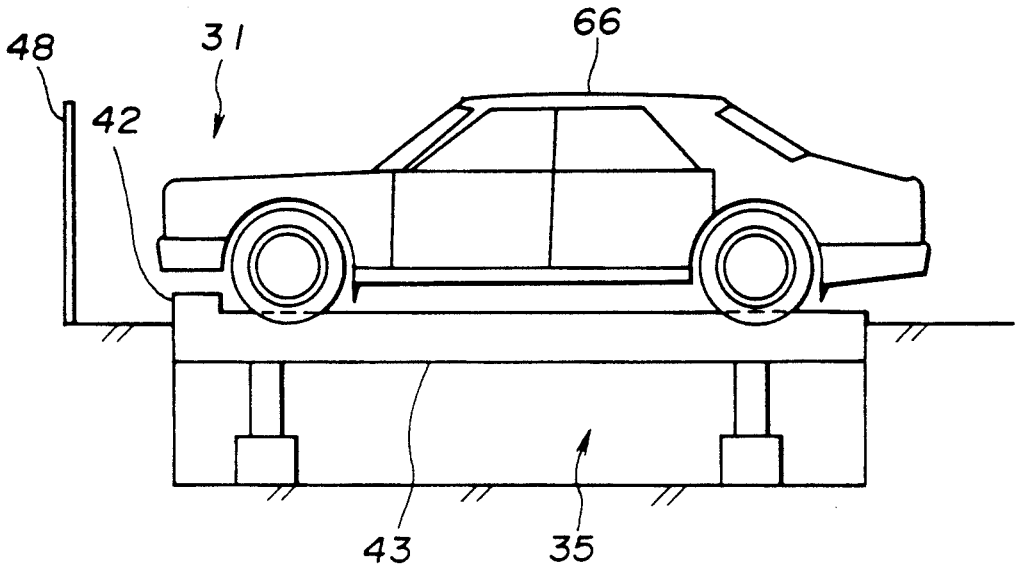
FIG. 9 is a sectional view showing a positioning device means of the present invention.
Figure 10:
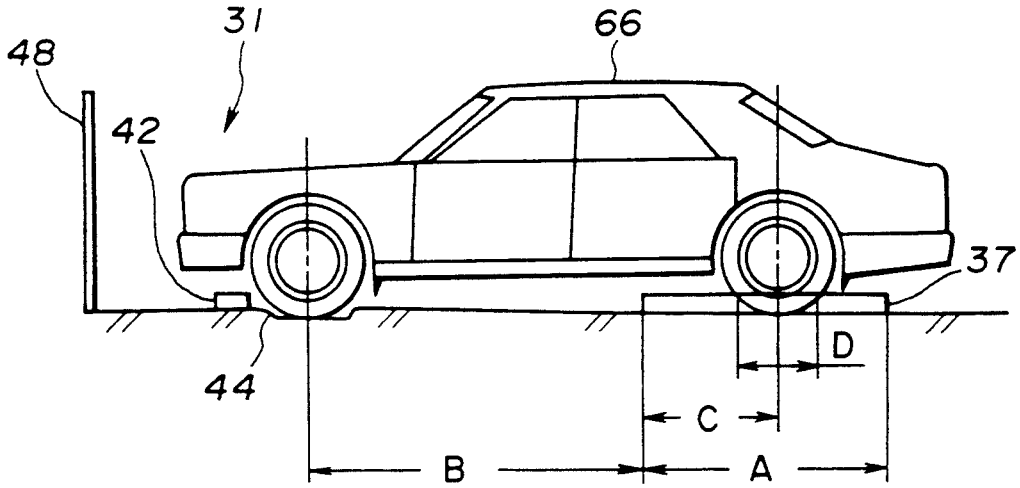
FIG. 10 is an explanatory view showing positions of the positioning device means and an area sensor at the entrance of the multistory parking lot of the present invention.

A motor vehicle detection means 33 has motor vehicle pass detection sensors 40, an approach path in the entrance 31 of the multistory parking lot being positioned between the motor vehicle pass detection sensors 40, and motor vehicle detection sensors 41, a motor vehicle transfer position being positioned diagonally between the motor vehicle detection sensors 41. A safety guard 34 capable of moving upward and downward is positioned above the approach path before the motor vehicle pass detection sensor 40. A positioning means 35 has a guide section 43 where a motor vehicle stop 42 extruding at the front end of the guide section 43 is positioned as shown in the sectional view of FIG. 9 and a positioning section 44 with a recess having a predetermined width and length, which is arranged on both sides of the guide section 43 as shown in the sectional view of FIG. 10. The guide section 43 is moved upward and downward by a hydraulic cylinder or the like. When a motor vehicle approaches the entrance 31 of the multistory parking lot, the guide section 43 rises to restrain the wheels from moving right and left by guiding the inside of wheels and descends when the motor vehicle stops at a normal position. The positioning section 44 determines a position of the motor vehicle by causing the front wheels of the motor vehicle to drop into the recess.

The motor vehicle position detection means 36 has front portion runout detection sensors 45 at a position before the positioning means 35, a width direction of a motor vehicle being positioned between the front portion runout detection sensors 45, front wheel runout detection sensors 46 positioned between the motor vehicle stop 42 of the positioning means 35 and the positioning portion 44 and rear portion runout detection sensors 47 positioned adjacent to the pathway 80.

The area sensor 37 comprises an optical sensor assembly and a pressure sensor assembly each having a predetermined length A. As shown in the sectional view of FIG. 10, the area sensor 37 is positioned at a predetermined distance B from the positioning section 44 along the approach path. The door opening detection sensor 38 is placed on the sides of the approach path between the positioning section 44 and the area sensor 37. A safety mirror 48 is arranged at a front end of the entrance 31 of the multistory parking lot, the pathway for an operator being provided in a vehicle side of the entrance 31 of the multistory parking lot.

The control device 32 at the entrance of the multistory parking lot 31 has a CPU 51 for controlling all operations at the entrance 31, ROM 52 for storing an operation program, a distance B from the positioning section 44 to the area sensor 37, a length A of the area sensor 37, RAM 53, a driving means 54 for driving a safety guard, an alarm means 55, shaft distance calculation means 56 and an output means 57. The shaft distance calculation means 56 calculates a distance between front wheels and rear wheels of a motor vehicle coming into the multistage parking lot and sizes of tires. The output means 57 outputs various information to the apparatus 1 for transferring a motor vehicle by using signal transmission means 58 employing, for example, light, electromagnetic waves or the like.

Figure 12:
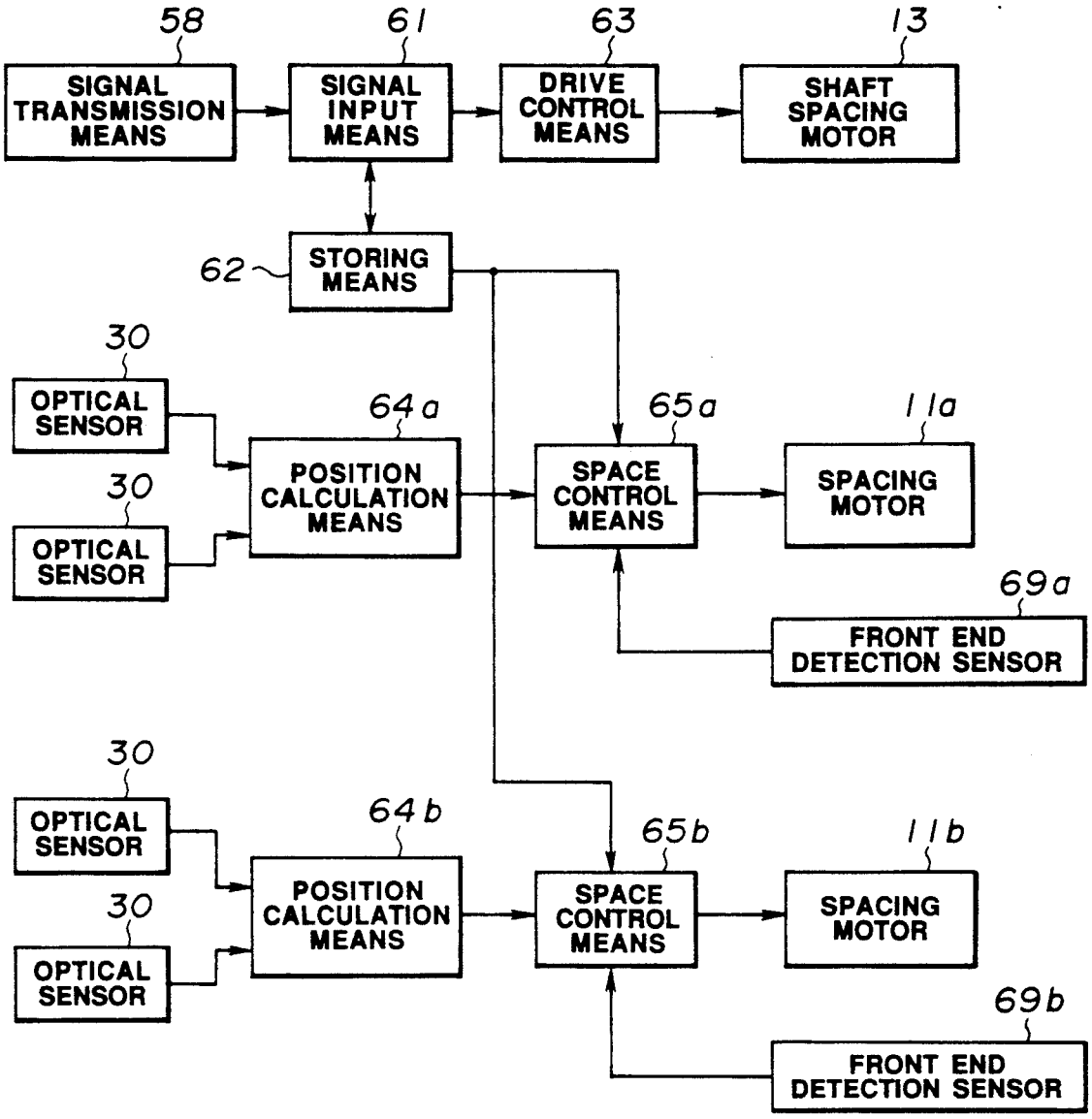
FIG. 12 a block diagram showing a control section of the apparatus for transferring a motor vehicle of the present invention.

As shown in the block diagram of FIG. 12, a control section of the apparatus for transferring a motor vehicle has signal input means 61 for inputting information from the control device 32 of the entrance 31, storing means 62, drive control means 63, position calculation means 64*a*, 64*b* and distance control means 65*a*, 65*b*. The storing means 62 stores various information on a distance (B+C) between a shaft of front wheels and a shaft of rear wheels which is sent from the control device 32 of the entrance 31 and the like. The drive control means 63 moves a pair of slide forks 5, 6 on the side of rear wheels by driving the shaft distance changing motor 13 in response to a distance signal stored in the storing means 62.

The position calculation means 64*a* calculates the relationship between tires of front wheels 67 and slide forks 3, 4, receiving signals from optical sensor 30 placed at the ends of a pair of slide forks on the side of the front wheels respectively. The position calculation means 64*b* calculates the relationship between tires of rear wheels 68 and slide forks 5, 6, receiving signals from optical sensor 30 placed at the ends of a pair of slide forks on the side of the rear wheels respectively. The position control means 65*a*, 65*b* drive the distance changing motors 11*a*, 11*b* in response to signals from the position calculation means 64*a*, 64*b* respectively.

Figure 13:
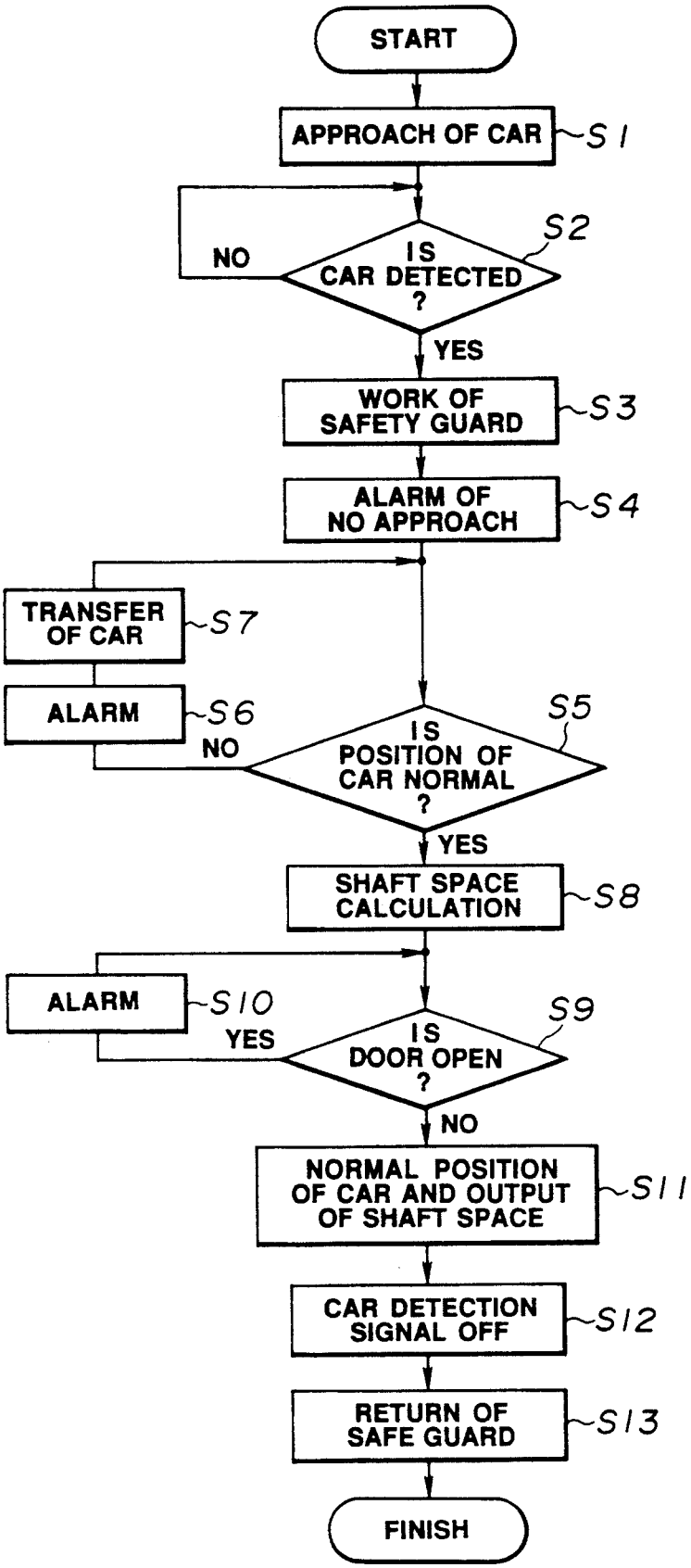
FIG. 13 is a flow chart showing a work of the safety device at the entrance of the multistory parking lot of the present invention.

Operation of the safety guard on the occasion of approach of a motor vehicle to the entrance 31 of the multistory parking lot having a structure as described above will now be described with specific reference to the flow chart of FIG. 13.

When a motor vehicle approaches the entrance 31 from a direction of arrow E and passes a position of the safety guard 34 (step S1), it is detected by the motor vehicle pass detection sensor 40 that the motor vehicle has passed the position of the safety guard 34 and a signal of pass of the motor vehicle is sent to the control device 32. When the control device 32 receives the signal of pass of the motor vehicle from the motor vehicle pass detection sensor 41, the guide section 43 of the positioning means 35 is raised. An operator driving the motor vehicle moves the motor vehicle, confirming the guide section 43 and the safety mirror 48 positioned at the front end and stops the motor vehicle when the front wheels 67 of the motor vehicle fall in the positioning section 44. Since the operator can move the motor vehicle forward, confirming the guide section 43 and the safety mirror 48, the operator can move the motor vehicle straight toward the positioning section 44.

When the motor vehicle stops, the motor vehicle detection sensor 41 detects that the motor vehicle has reached a transfer position and sends a motor vehicle detection signal to the control device 32 (step S2). When the CPU 51 receives the motor vehicle detection signal after having received a motor vehicle pass signal, the CPU prevents the following motor vehicle from approaching by causing a drive means for driving the safety guard drive means 54 to work and causing the safety guard 34 to descent (step S3). Simultaneously, the following motor vehicle is alarmed by voice and display of the alarm means 55 notifying that there is a preceding motor vehicle at the entrance 31 (Step S4). Since the safety guard 34 is caused to work and alarms the following motor vehicle when it is detected that a motor vehicle approaches the entrance 31, it prevents the following motor vehicle from approaching the entrance 31 when a transfer operation of the preceding motor vehicle is carried out. Therefore, the operation is carried out in safety.

The front portion runout detection sensor 45 and the front wheel runout detection sensor 46 of the motor vehicle position detection sensor means 36 detect whether the front portion and the front wheels of a motor vehicle have run out of a predetermined position or not, and the rear portion runout detection sensor 47 detects whether the rear portion of the motor vehicle has run out of a predetermined position or not (step S 5). When a shift of the motor vehicle from a predetermined position is detected by the front wheel runout detection sensor 46, for example, as a result of confirming the position of the motor vehicle by use of each of the motor vehicle position detection means 36, a position shift signal is sent from the front wheel runout detection sensor 46 to the control device 32. When the CPU 51 receives the position shift signal, the operator is informed of the shift of the motor vehicle from the predetermined position by means of display of the alarm means 55 (step S 6). Upon receiving the alarm, the driver moves the motor vehicle to a predetermined normal position (step S 7).

When the CPU 51 does not receive the position shift signal of the motor vehicle from each of the motor vehicle position detection means within a predetermined time after the motor vehicle detection sensor 41 has received a motor vehicle detection signal or when the position shift of the motor vehicle is not corrected since the CPU outputs an alarm by use of the alarm means 55 after the CPU has received a position shift signal of the motor vehicle, the guide section 43 of the positioning means 35 is caused to descend, and a detection signal of the tires of the rear wheels 68, which has been read by the area sensor 37, is sent to the shaft distance calculation means 56.

The shaft distance calculation means 56 causes RAM 53 to temporarily store a position C of the tires of the rear wheels and the size D of the tires in the range of the area sensor 37 by calculating the position C of the tires and the size D of the tires on the basis of a sent signal and the length A of the area sensor 37 stored by ROM 52. The RAM 53 is caused to store a determined position C of the tires, the positioning section 44 previously stored in the ROM 52 and a distance (B+C) between the shafts of the front and rear wheels on the basis of the distance between the area sensor 37 and the shaft of the front wheel (step S 8).

Then, the CPU examines whether a door opening signal is sent from the door opening detection sensor 38 or not (step S 9), and when the door opening signal is sent, the operator is informed of an alarm by the alarm means 55 that the door is open (step S 10). When the door of the motor vehicle is closed by the alarm, a door closing signal is sent from the door opening detection sensor 38 and a signal that the operator left the motor vehicle on the occasion of working of the operator detection sensor 39 is sent, the CPU 51 sends signals of the shaft distance (B+C) stored in the RAM 53 and the size D of the tires together with a normal motor vehicle position signal to the output means 57. The output means 57 sends the normal motor vehicle car position signal and the signals of the shaft distance (B+C) and the size D of the tires to the apparatus 1 for transferring a motor vehicle via the signal transmission means 58 (step S 11). Since it is detected whether a door of a motor vehicle stopping at a normal stop position is open or not and whether an operator left the motor vehicle or not and the motor vehicle is transferred by means of the apparatus 1 for transferring a motor vehicle only when the door of the motor vehicle is closed and the operator left the motor vehicle in this way, the motor vehicle can be transferred in safety.

Figure 14:
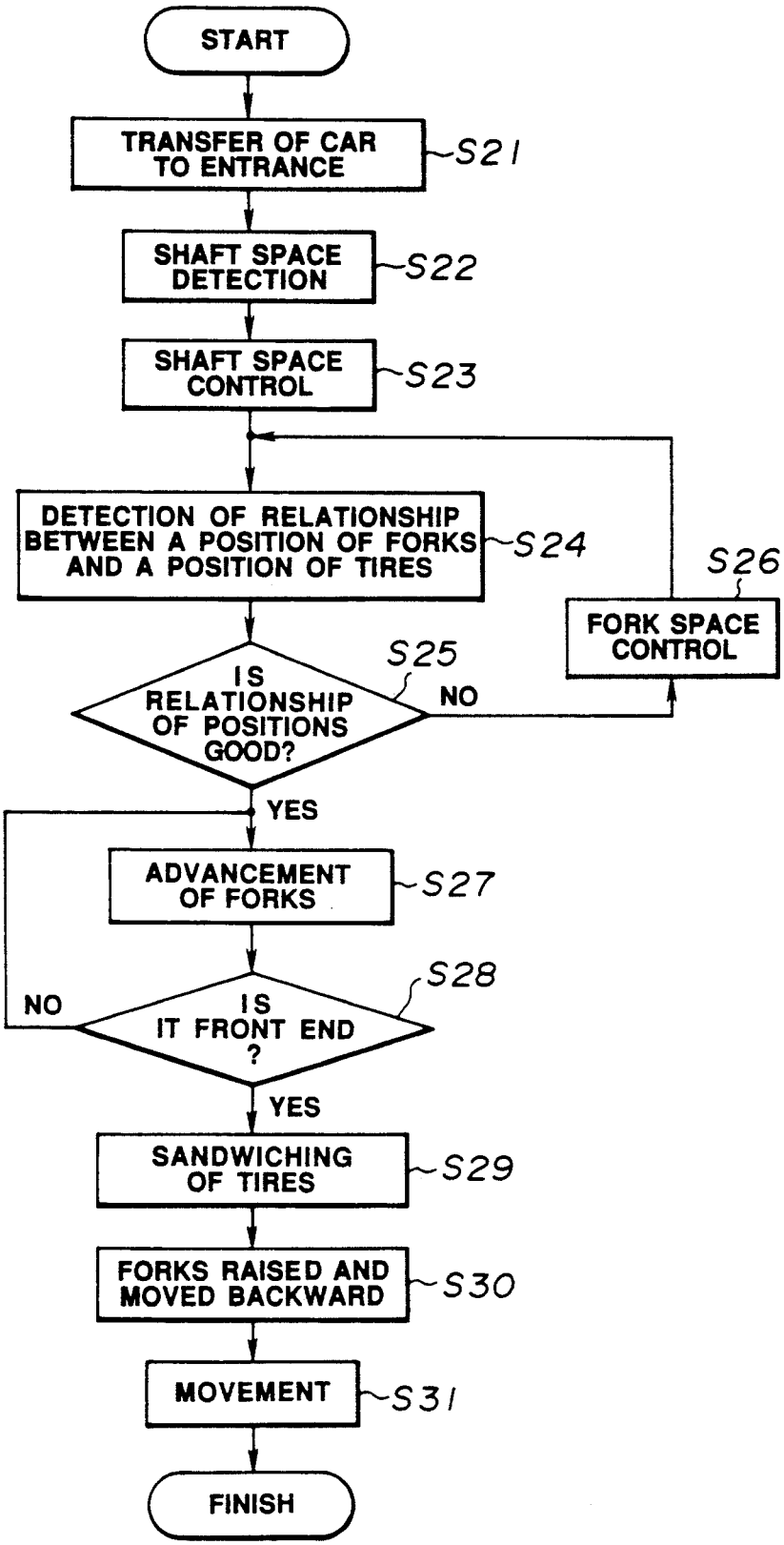
FIG. 14 is a flow chart showing the steps of transfers of a motor vehicle according to the present invention.
Figure 15:
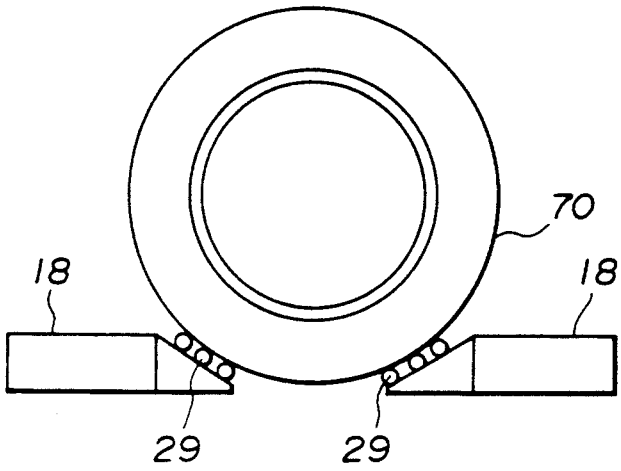
FIG. 15 is an explanatory view showing a state that a tire of a motor vehicle is held according to the present invention.

Then, an operation in the case where the motor vehicle having entered the entrance 31 is transferred into a containnment rack of the multistory parking lot by use of the motor vehicle transfer apparatus 1 will now be described with specific reference to the flow chart of FIG. 14.

When the signals of the shaft distance (B+C) and the size D of the tires are sent from the signal transmission means 58 of the entrance 31 to signal input means 61 after the positioning of the motor vehicle has been carried out by moving the motor vehicle to the entrance 31 and causing the front wheels of the motor vehicle to drop into the recess of the positioning section 44, the sent signal of the shaft distance (B+C) and signal of the size D of the tires are stored in the storing means 62 (step S 21, S 22). Thereafter, signals of the shaft distance (B+C) between the front and rear wheels are sent to the drive control means 63 after the shaft distance has been calculated. The drive control means 63 moves the slide forks 5, 6 on the side of the rear wheels by driving the shaft distance changing 13 of the apparatus 1 for transferring a motor vehicle in response to the sent signal of the shaft distance (B+C) and causes the center of the slide forks 5, 6 to coincide with the center between the tires of the rear wheels 68 (step S 23). Therefore, a shaft distance of various sorts of motor vehicles can be automatically adjusted.

Then, light is irradiated on the front wheels 67 from each of the optical sensors mounted at the end of the top beam 18 of the slide forks 3, 4 on the side of the front wheels as shown in FIG. 7. A reflected light from the front wheels 67 is received, and a signal of the reflected light is sent to the position calculation means 64*a*. The position calculation means 64*a* calculates a position of the slide forks 3, 4 relative to the tires of the front wheels by means of the signal sent from both the optical sensors 30 and sends a signal of the position of the slide forks 3, 4 to the distance control means 65*a*. In the same way, light from the optical sensor 30 at the end of the top beam 18 of the slide forks 5, 6 on the side of the rear wheels is irradiated on the rear wheels 68. A signal of a reflected light is sent to the position calculation means 64*b*.

A position of the slide forks 5, 6 relative to the tires of the rear wheels is calculated by the position calculation means 64*b*, and a signal of the position of the slide forks 5, 6 is sent to the shaft distance control means 65*b* (step S24). The shaft distance control means 65*a*, 65*b* judges on the basis of the signal of the position of a pair of the slide forks and the size of the tires stored in the storing means 62 whether a distance between the slide forks 3 and 4 and a distance between the slide forks 5 and 6 are respectively wider than the size of the tires or not (step S25). When the distance between the slide forks 3 and 4 and the distance between the slide forks 5 and 6 are respectively smaller than the size of the tires, the distance between the slide forks 3 and 4 and the distance between the slide forks 5 and 6 are respectively increased by reversely rotating the distance changing motors 11*a*, 11*b* (step S26). In the case where a support distance between the slide forks 3, 4 or between the slide forks 5, 6 is narrower or wider than an exact hold distance necessary for supporting an individual tire, or in the case where the distance from a first center point between the slide forks 3, 4 to a second center point between the slide forks 5, 6 does not accord with the wheel base, or in the case where a center point of the distance from the first center point to the second center point does not accord with a center point of the wheel base, the CPU 51 sends a signal to the driving motor for the gear assembly 20 to stop the advancement of the sliding forks 3, 4, 5, 6 and simultaneously sends a signal to an alarm device.

When the distance between the slide forks 3 and 4 and the distance between the slide forks 5 and 6 are respectively increased by a predetermined distance from the size of the tires, the fork expansion motors 15*a*, 15*b* are rotated positively. The gear 19 mounted on the base plate 16 of each of the slide forks 3 to 6 is rotated through the rotation of the fork expansion motors 15*a*, 15*b*, and the center beam 17 is moved to the entrance 31 by the gear 19 and the rack 22 on the lower side of the center beam 17 (step S27). When the center beam 17 moves forward, the pinion 23 mounted on the center beam 17 moves, engaging with the rack 21 on the upper side of the base plate 16 and with the rack 24 on the lower side of the top beam 18 and moves the top beam 18 by a distance two times greater than a distance of movement of the center beam 17.

Since the distance of movement of the top beam 18 can be increased two times greater than the distance of movement of the center beam 17 in this way, the length of the slide forks 3 to 6 can be equal to the width of the motor vehicle and the entire width of the motor vehicle transfer apparatus 1 can be decreased.

Moreover, since the distance between the slide forks 3, 4 on the side of the front wheels and the slide forks 5, 6 on the side of the rear wheels is caused to coincide with the distance between the shafts, and the distance between the slide forks 3, 4 and the slide forks 5, 6 are adjusted in response to the size of the wheels when the slide forks 3 to 6 are moved forward, the top beam 18 can be moved without contacting the sides of the tires, which prevents the tires from having defects thereon.

When the center portion of the center beam 17 advances to the end of the base plate 16, and advanced end detection sensors 69*a*, 69*b* mounted on the slide forks 3, 4 and 5, 6 work, the fork expansion motors 15*a*, 15*b* stop their rotation (step S28). When the center beam 17 reaches the end of the base plate 16 as shown in FIG. 4, the cam 28 mounted on the center portion of the center beam 17 engages with the roller 27 at the end of the base plate 16 and supports a load at the end of the base plate 16.

After the top beams 18 have reached the end of the base plate 16, the shaft distance changing motors 11*a*, 11*b* are rotated positively, the tires of the front wheels 67 are held by the slide forks 3, 4, and the tires of the rear wheels 68 are held by the slide forks 5, 6 (step S29). When the tires are held by each of the slide forks 3 to 6, for example, the rollers 29 for holding tires in three stages which are mounted on the hold face 18*a* for holding tires of the top beam 18 contact the periphery of the tire 70 and hold the tire 70 against rotating. Therefore, the resistance of the slide forks against the tire 70 can be decreased.

After it has been detected that the tires of the front and rear wheels are held by the slide forks 3, 4 and 5, 6, the apparatus 1 for transferring a motor vehicle is lifted until the tires leave the ground surface. Then, the slide forks 3 to 6 are moved backward by reversely rotating the fork expansion motors 15*a*, 15*b*, and the motor vehicle is moved toward the frame body 2 (step S30). When it is detected that the slide forks 3 to 6 reach the rear end of the base plate, the rotation of the fork expansion motors 15*a*, 15*b* is stopped.

Figure 16:
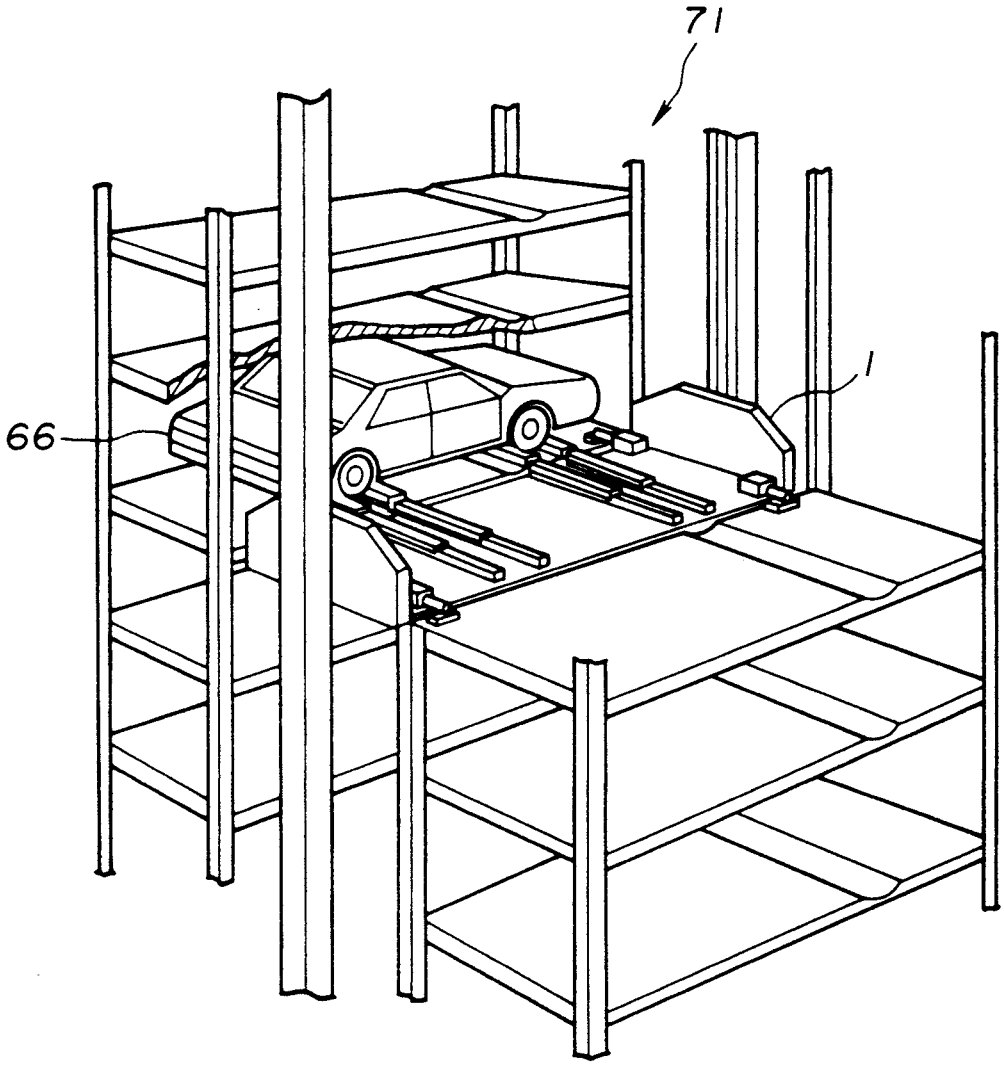
FIG. 16 is a perspective view showing a part of the containment rack of the present invention.

Thereafter, as shown in FIG. 16, the apparatus 1 for transferring a motor vehicle is moved to a predetermined position of the containment rack 71. After the slide forks 3 to 6 have been moved forward or backward, the motor vehicle 66 is placed in a predetermined position by increasing a distance between the slide forks 3, 4 and a distance between the slide forks 5, 6 (step S 31). Then, the following motor vehicle is transferred after the slide forks 3 to 6 have been returned and moved to the entrance 31.

In the case where a motor vehicle placed in the containment rack 71 is sent off, the motor vehicle is transferred by operating the slide forks 3 to 6 in such a manner as described above.

In the above-described example, the case where the distance between the shafts of the front and rear wheels is calculated by means of the signals from the area sensor 37 is described. However, the distance between the shafts of the front and rear wheels can be calculated by reading sorts of motor vehicles by means of a mark sheet.

Figure 17:
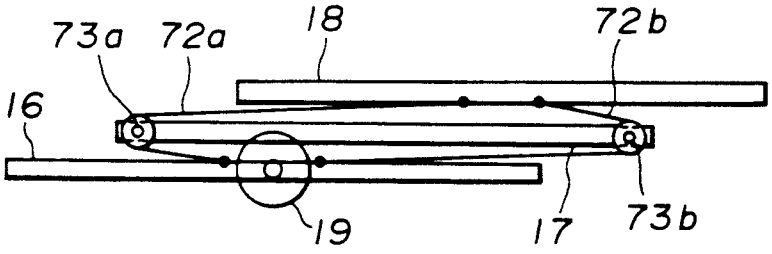
FIG. 17 is an explanatory view showing a structure of another slide fork of the present invention.

In the above-described example, the case where the top beam 18 of the slide forks 3 to 6 is moved by the rack 21 on the upper surface 16 of the base plate, the pinion 23 mounted on the center beam 17 and the rack 24 on the lower surface of the top beam 18 is described. As shown in the explanatory view of FIG. 17, the top beam 18 can be moved by using chains 72*a*, 72*b*. The top beam 18 can be advanced by a distance two times greater than the distance of movement of the center beam 17 relative to the base plate 16 by the steps of fixing each of the ends of the chains 72*a*, 72*b* near the center portion of the base plate 16, fixing each of the other ends of the chains 72*a*, 72*b* near the center of the top beam 18, and straining the chains 72*a*, 72*b* by means of sprockets 73*a*, 73*b* mounted rotatably on both ends of the center beam 17.

According to the apparatus for transferring a motor vehicle of the present invention, since a pair of slide forks are arranged at a definite interval in a frame body on the side of front wheels and on the side of rear wheels respectively, the motor vehicle can be stably transferred to a containment rack without using any pallet. Accordingly, a number of pallets are not required for a multistory parking lot, which can decrease an equipment cost of the multistory parking lot.

Since it is inspected whether the motor vehicle runs out or not from a normal position when a motor vehicle to be transferred has approached an entrance and stopped at the entrance, and it is alarmed that the motor vehicle has run out of the normal position when the motor vehicle has done it, the motor vehicle can be caused to stop exactly at a position, with which a position of the apparatus for transferring a motor vehicle coincides.

Further, since a position of tires of the motor vehicle stopped by positioning the motor vehicle is detected; a distance between a shaft of front wheels and a shaft of rear wheels is calculated; and information of the calculated distance between the shafts is sent to the apparatus for transferring a motor vehicle, the two pairs of slide forks positioned in the apparatus for transferring a motor vehicle on the side of the front wheels and on the side of the rear wheels respectively can be adjusted to positions of the front wheels and rear wheels.

What is claimed is:

1. An apparatus for transferring a motor vehicle, comprising:

a frame body;

two pair of slide forks, each of which holds front wheels and rear wheels of a motor vehicle, respectively, and moves the motor vehicle, said two pairs of slide forks moving in a direction perpendicular to a longitudinal direction of the frame body;

said two pairs of slide forks having a first pair of slide forks positioned on a side of said frame body corresponding to the front wheels, and a second pair of slide forks positioned on a side of said frame body corresponding to the rear wheels;

each of said two pairs of slide forks having a base plate, a center beam, and a top beam, said center beam being connected to the base plate by means of a first shuttle movement mechanism for moving on the base plate, and said top beam being connected to the base plate by means of a second shuttle movement mechanism for moving on the center beam;

said base plate having rollers on both sides of each end thereof, and said center beam has a cam on both sides of a center portion thereof, said cams of the center beam engaging with said rollers of said base plate;

a first adjusting means for adjusting a distance between said first pair of slide forks and said second pair of slide forks to be equal to a distance between a shaft of the front wheels and a shaft of the rear wheels, said first adjusting means being positioned on at least one side selected from the side of said frame body corresponding to the front wheels and the side of said frame body corresponding to the rear wheels, and said first adjusting means moving at least one pair of said two pairs of slide forks in a longitudinal direction of the frame body; and a second adjusting means for adjusting a hold distance between slide forks forming each of said first pair of slide forks and said second pair of slide forks, said hold distance being adjusted to a diameter of tires of each of said wheels.

2. The apparatus of claim 1, wherein said base plate has a rolling guide, the center beam moving along said rolling guide.

3. The apparatus of claim 1, wherein said top beam has a rolling guide, the top beam moving along said rolling guide.

4. The apparatus of claim 1, wherein each of said pair of slide forks has hold faces for holding tires and a plurality of rollers for holding tires, said hold faces facing each other and said rollers being arranged in a longitudinal direction of said hold faces.

5. The apparatus of claim 1, wherein said second adjusting means moves the first pair of slide forks on the side corresponding to the front wheels in the longitudinal direction of the frame body and adjusts the distance between the first pair of slide forks and the second pair of slide forks to the distance between the shaft of the front wheels and the shaft of the rear wheels.

6. The apparatus of claim 1, wherein said second adjusting means moves the second pair of slide forks on the side corresponding to the rear wheels in the longitudinal direction of the frame body and adjusts the distance between the first pair of slide forks and the second pair of slide forks to the distance between the shaft of the front wheels and the shaft of the rear wheels.

7. An apparatus for transferring a motor vehicle, comprising:

a frame body;

two pairs of slide forks, each of which holds front wheels and rear wheels of a motor vehicle, respectively, and moves the motor vehicle, said two pairs of slide forks moving in a direction perpendicular to a longitudinal direction of the frame body;

a first pair of said two pairs of slide forks being positioned on a side of said frame body corresponding to the front wheels, and a second pair of said two pairs of slide forks being positioned on a side of said frame body corresponding to the rear wheels;

a first adjusting means for adjusting a distance between said first pair of slide forks and said second pair of slide forks to be equal to a distance between a shaft of the front wheels and a shaft of the rear wheels, said first adjusting means being positioned on at least one side selected from the side of said frame body corresponding to the front wheels and the side of said frame body corresponding to the rear wheels, and said first adjusting means moving at least one pair of said two pairs of slide forks in a longitudinal direction of the frame body; and a second adjusting means for adjusting a hold distance between slide forks forming each of said first pair of slide forks and said second pair of slide forks, said hold distance being adjusted to a diameter of tires on each of said wheels;

said second adjusting means comprising a fork position detection means, a hold distance control means and a hold distance changing means;

said fork position detection means having a position sensor mounted at an end of each pair of said two pairs of slide forks and a position calculation means for calculating a relationship between a position of the tires and one of said two pairs of slide forks by receiving a signal from a position sensor mounted on a respective one of said two pairs of slide forks; and said hold distance control means controlling a distance between one pair of said two pairs of slide forks by driving the hold distance changing means in response to an output signal from the position calculation means corresponding to the relationship between a position of the tires and such one pair of slide forks.

8. An apparatus for transferring a motor vehicle, comprising:

a frame body;

two pairs of slide forks, each of which holds front wheels and rear wheels of a motor vehicle, respectively, and moves the motor vehicle, said two pairs of slide forks moving in a direction perpendicular to a longitudinal direction of the frame body;

a first pair of said two pairs of slide forks being positioned on a side of said frame body corresponding to the front wheels, and a second pair of said two pairs of slide forks being positioned on a side of said frame body corresponding to the rear wheels;

a first adjusting means for adjusting a distance between said first pair of slide forks and said second pair of slide forks to be equal to a distance between a shaft of the front wheels and a shaft of the rear wheels, said first adjusting means being positioned on at least one side selected from the side of said frame body corresponding to the front wheels and the side of said frame body corresponding to the rear wheels, and said first adjusting means moving at least one pair of said two pairs of slide forks in a longitudinal direction of the frame body; and a second adjusting means for adjusting a hold distance between slide forks forming each of said first pair of slide forks and said second pair of slide forks, said hold distance being adjusted to a diameter of tires on each of the wheels;

said second adjusting means comprising a fork position detection means, a hold distance control means and a hold distance changing means;

said hold distance control means having an alarm device for stopping advancement of the two pairs of slide forks by outputting an alarm when the relationship between the tires and an associated pair of said two pairs of slide forks is judged as being abnormal.

9. A multistory parking lot comprising:

an entrance of the multistory parking lot;

a rack for containing a motor vehicle;

an apparatus for transferring a motor vehicle to the rack for containing a motor vehicle, said apparatus having:

a frame body;

two pairs of slide forks, each of which holds front wheels and rear wheels, respectively, and moves the vehicle, said two pairs of slide forks moving in a direction perpendicular to a longitudinal direction of the frame body;

a first pair of said two pairs of slide forks being positioned on a side of said frame body corresponding to the front wheels, and a second pair of said two pairs of slide forks being positioned on a side of said frame body corresponding to the rear wheels;

a first adjusting means for adjusting a distance between said first pair of slide forks and said second pair of slide forks to be equal to a distance between a shaft of the front wheels and a shaft of the rear wheels, said first adjusting means being positioned on at least one side selected from the side of said frame body corresponding to the front wheels and the side of said frame body corresponding to the rear wheels, and said first adjusting means moving at least one pair of said two pairs of slide forks in a longitudinal direction of the frame body; and a second adjusting means for adjusting a distance between the first pair of slide forks and the second pair of slide forks, the distance between the slide forks being adjusted to a diameter of tires on each of the wheels; and a safety apparatus positioned at the entrance of the multistory parking lot, said safety apparatus comprising:

a positioning means for guiding a motor vehicle and determining a stop position of the motor vehicle, said positioning means rising and guiding said front wheels and said rear wheels of the motor vehicle when the motor vehicle approaches the entrance and positioning at least one of the front wheels and the rear wheels of the motor vehicle;

a motor vehicle position detection means for detecting whether a position of a stopped motor vehicle is appropriate or not, said motor vehicle position detection means having a plurality of sensors for detecting a stop position of a motor vehicle;

an area sensor means for detecting a position of wheels different from wheels whose position is determined by the positioning means, said area sensor being arranged along a path positioned at a predetermined distance from the positioning means and having a predetermined length;

a shaft distance calculation means for calculating a distance between a shaft of said front wheels and a shaft of said rear wheels of a motor vehicle having entered the multistory parking lot, said shaft distance calculation means calculating a distance between the shaft of said front wheels and the shaft of said rear wheels on the basis of a signal from the area sensor means, a position stored previously, a distance from the area sensor means and a length of the area sensor means; and an output means for sending various information to the apparatus for transferring a motor vehicle.

10. The multistory parking lot of claim 9, wherein said motor vehicle position detection means has a sensor means for detecting a front end of a motor vehicle and a rear end of the motor vehicle.

11. The multistory parking lot of claim 9, wherein said safety apparatus further comprises motor vehicle detection means including a motor vehicle pass sensor mounted at the entrance of the multistory parking lot and a motor vehicle detection sensor mounted at a position of transfer of a motor vehicle.

12. The multistory parking lot of claim 11, which further comprises a safety guard which is positioned at the entrance of the multistory parking lot, which prevents a following motor vehicle from approaching the entrance, being operated by a motor vehicle pass signal from the motor vehicle pass sensor of the motor vehicle detection means, and which returns on receiving a signal from the motor vehicle detection sensor that there is no approaching motor vehicle.

13. The multistory parking lot of claim 9, which further comprises:

a door opening detection means for detecting opening and closing of a door of a stopped motor vehicle, said door opening detection means being placed on a vehicle side of a pathway for an operator provided on one side of the entrance of the multistory parking lot; and an operator detection means for detecting passing of an operator coming out of the motor vehicle, the operator detection means being placed on the pathway.

14. The multistory parking lot of claim 9, wherein said safety device further comprises an alarm means for outputting an alarm on the basis of an abnormal signal.

15. The multistory parking lot of claim 9, wherein said area sensor means is an optical sensor assembly having a predetermined length, which is positioned at a predetermined distance from the positioning means.

16. The multistory parking lot of claim 9, wherein said area sensor means is a pressure sensor assembly having a predetermined length, which is positioned at a predetermined distance from the positioning means.

* * * * *